US006638115B2

(12) United States Patent
Mochizuki

(10) Patent No.: US 6,638,115 B2
(45) Date of Patent: Oct. 28, 2003

(54) CONNECTOR WITH COVER MEMBER

(75) Inventor: Shinji Mochizuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/161,631

(22) Filed: Jun. 5, 2002

(65) Prior Publication Data

US 2002/0187683 A1 Dec. 12, 2002

(30) Foreign Application Priority Data

Jun. 6, 2001 (JP) ..... P2001-171136

(51) Int. Cl.[7] ..... H01R 13/514
(52) U.S. Cl. ..... 439/701; 439/718
(58) Field of Search ..... 439/701, 718, 439/712, 710, 590, 937; 29/863, 749, 857

(56) References Cited

U.S. PATENT DOCUMENTS 4,067,637 A * 1/1978 Narozny ..... 439/634
5,037,319 A * 8/1991 Hatagishi ..... 439/140
5,794,332 A * 8/1998 Yamamoto et al. ..... 29/863

FOREIGN PATENT DOCUMENTS

JP 9-161878 6/1997
JP 2000-231959 8/2000

* cited by examiner

*Primary Examiner*—Tho D. Ta
(74) *Attorney, Agent, or Firm*—Sughrue Mion, PLLC

(57) ABSTRACT

A connector includes insulating housings, each having a plurality of juxtaposed terminal receiving portions each having an upper opening for the insertion of a connection terminal, and a cover member for covering the upper openings of the terminal receiving portions. The insulating housing is formed by cutting a chain housing, having the terminal receiving portions formed by a plurality of partition walls formed upright on a long base plate portion, into a section having a required number of terminal receiving portions. Terminal retaining portions, which are engageable with housing engagement portions of the connection terminals, inserted into the terminal receiving portions through the upper openings thereof, so as to position the terminals, are formed on the partition walls. Cover engagement portions, which are engageable respectively with the corresponding terminal retaining portions to connect the cover member to the insulating housing, are formed at the cover member.

8 Claims, 9 Drawing Sheets

CONNECTOR WITH COVER MEMBER

The present application is based on Japanese Patent Application No. 2001-171136, which is incorporated herein by reference.

BACKGROUND OF THE INVENTION

1. Field of the Invention

This invention relates to a connector comprising an insulating housing, having a plurality of juxtaposed terminal receiving portions each having an opening for the insertion of a connection terminal, and a cover member for covering the openings of the terminal receiving portions.

2. Related Art

FIG. 10 shows one known conventional connector for press-contacting terminals.

This connector 51 is disclosed, for example, in JP-A-9-161878, and comprises an insulating housing 54, having a plurality of juxtaposed terminal receiving chambers 52 each having an upper opening 59 for the insertion of a press-contacting terminal (not shown), and a cover 56 for closing the upper openings 59.

The cover 56 is integrally connected to an upper wall of the insulating housing 54 through thin hinges 57 so as to be opened and closed.

The press-contacting terminals are mounted respectively in the terminal receiving chambers 52 separated from one another by side walls 52*a*, and after a corresponding wire (not shown) is press-contacted to the associated press-contacting terminal, the upper openings 59 are closed by the cover 56.

In the closed condition of the cover 56, lock claws 56*a*, formed respectively on opposite side edges of the cover 56 in a projected manner, are engaged respectively in cover retaining portions 54*a*, formed in a recessed manner in inner surfaces of opposite side walls of the insulating housing 54, respectively, thereby holding the cover 56 on the insulating housing 54.

Terminal retaining portions 58, corresponding respectively to the terminal receiving chambers 52, are formed on and project from a rear end surface of the cover 56, and when the cover 56 is closed, the terminal retaining portions 58 are engaged respectively with the connection terminals, mounted respectively in the terminal receiving chambers 52, thereby preventing the disengagement of the connection terminals in a double manner in cooperation with retaining piece portions of the connection terminals.

In the above connector 51, however, when the number of the terminal receiving chambers 52 is to be changed in accordance with a required number of circuits and a required circuit form, new molds for forming such an insulating housing must be produced, and in the case where there are required many kinds of connectors different in the number of poles, various molds are required, and this has invited a problem that the production cost is greatly increased.

And besides, in the above connector 51, the cover retaining portions 54*a*, which is engageable respectively with the lock claws 56*a* of the cover 56 to hold the cover 56 on the insulating housing 54 in such a manner that the cover 56 closes the upper openings 59, are formed in a recessed manner in the inner surfaces of the opposite side walls of the insulating housing 54, respectively.

Therefore, the opposite side walls of the insulating housing 54 have an increased thickness since the cover retaining portions 54*a* are formed in a recessed manner in these side walls, respectively, and this has invited a problem that the insulating housing 54 is increased in size.

SUMMARY OF THE INVENTION

It is therefore an object of this invention to solve the above problems, and more specifically to provide an improved connector which can easily meet with a required number of circuits and a required circuit form at low costs, and also can be formed into a compact size despite the fact that the connector is provided with a cover member for covering upper openings of terminal receiving portions.

The above object of the present invention has been achieved by a connector comprising:

- an insulating housing including
  - a long base plate,
  - a plurality of partition wall formed upright on the long base plate portion, so that a plurality of juxtaposed terminal receiving portions are formed, each terminal receiving portion having an opening for inserting a connection terminal, and
  - a plurality of terminal retaining portions formed on the partition walls, each of which is engageable with a housing engagement portion of the connection terminal inserted into the terminal receiving portion through the opening thereof so as to position the connection terminal,
- wherein the insulating housing is formed by cutting a chain housing into a section having a required number of terminal receiving portions; and
- a cover member for covering the openings of the terminal receiving portions, including
  - a cover engagement portion formed in the cover member, engageable with the terminal retaining portion which is formed at an end of the insulating housing so as to connect the cover member with the insulating housing.

In the connector, each of the terminal receiving portions is configured to have the same width with each other.

Further, each of the terminal retaining portions is configured to have the same structure with each other.

In the above construction, the insulating housing, having the plurality of juxtaposed terminal receiving portions, is formed by cutting the chain housing (beforehand integrally molded into a long, chain-like construction extending in the direction of juxtaposition of the terminal receiving portion) into a length or section, having a required number of terminal receiving portions, at a later stage. Therefore, the various insulating housings, having different numbers of terminal receiving portions, can be obtained merely by changing the cutting position.

Therefore, even when many kinds of connectors, having different numbers of poles, are required to be produced, it is not necessary to prepare many kinds of molds for the various insulating housings having different numbers of terminal receiving portions, and the production cost can be reduced.

When the chain housing is cut, the terminal retaining portions, formed on the partition walls, are exposed to the outer side walls of the insulating housing, and therefore the cover engagement portion can be engaged with the corresponding terminal retaining portion to connect the cover member to the insulating housing.

Therefore, any special cover retaining portion for engagement with the cover engagement portion of the cover member does not need to be provided at the insulating housing, and the increased size of the insulating housing, which would otherwise be caused by the provision of such cover retaining portion on the insulating housing, is prevented.

DETAILED DESCRIPTION OF THE PREFERRED EMBODIMENTS

One preferred embodiment of a connector of the present invention will now be described in detail with reference to the accompanying drawings.

Figure 1:
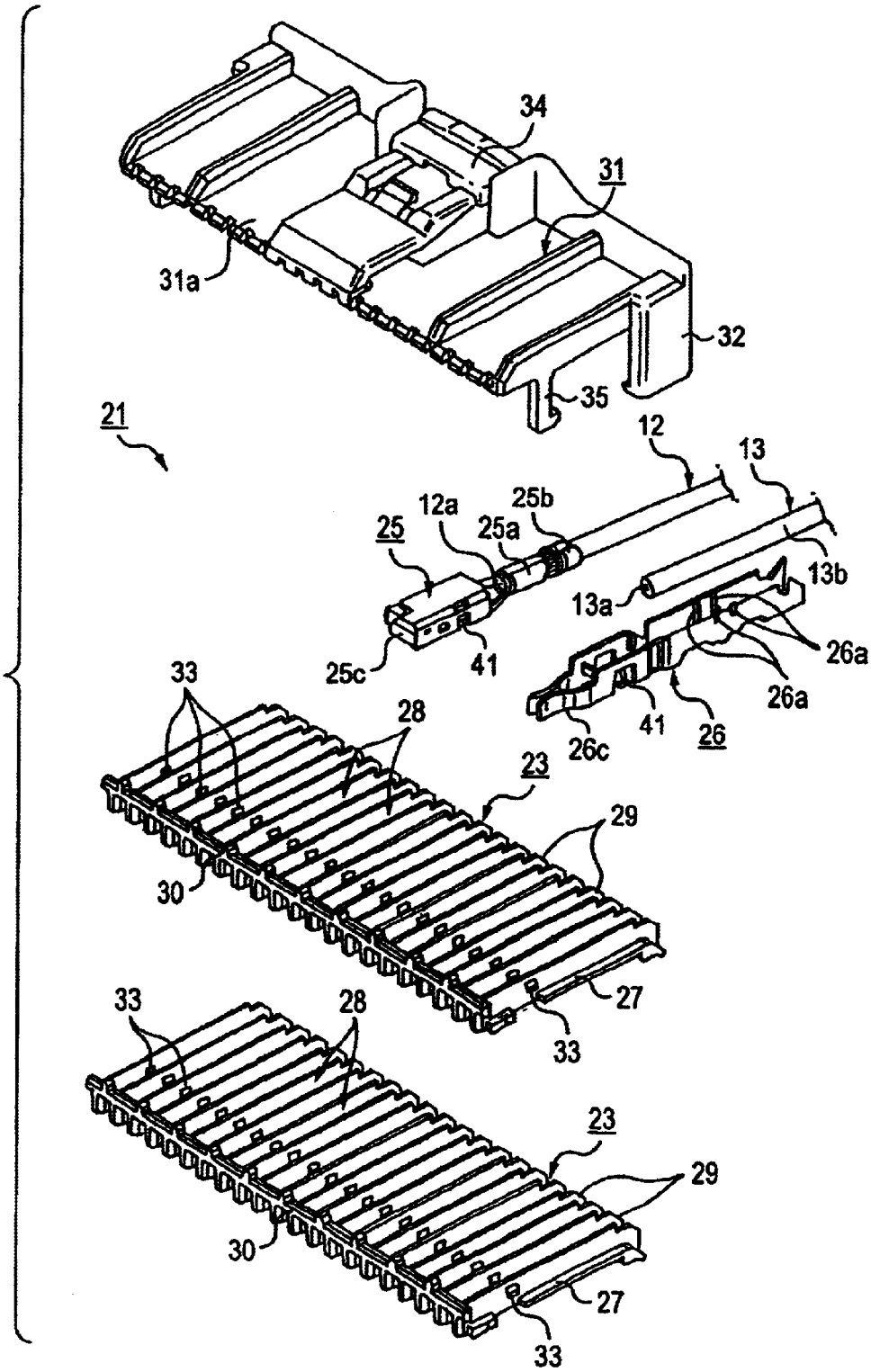
FIG. 1 is an exploded, perspective view of one preferred embodiment of a connector of the present invention.
Figure 2:
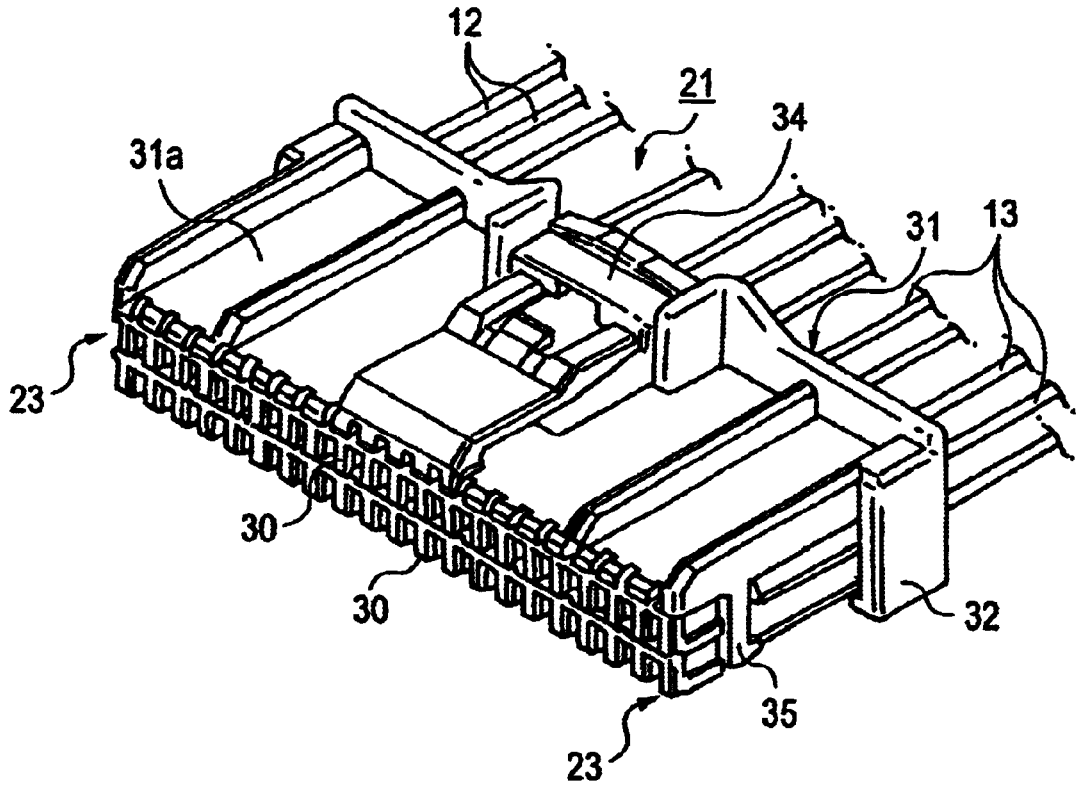
FIG. 2 is a perspective view of the connector of FIG. 1 in its assembled condition.
Figure 3:
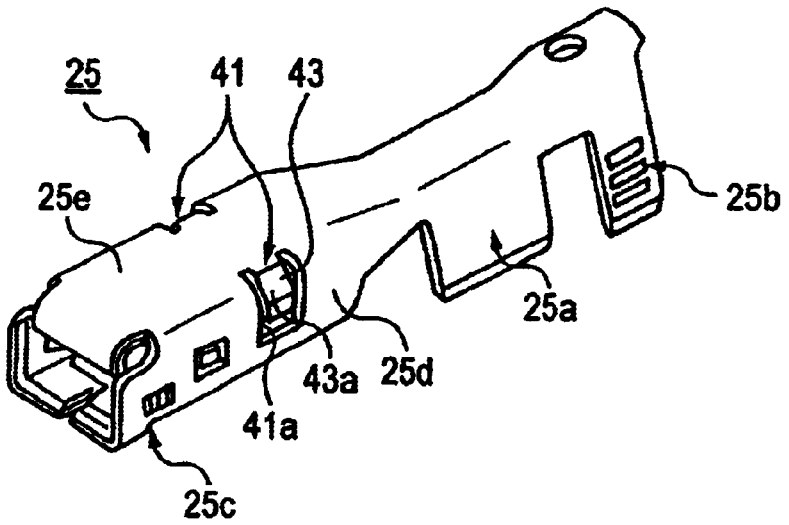
FIG. 3 is a perspective view of a press-clamping terminal in FIG. 1 as seen from the lower side.
Figure 4:
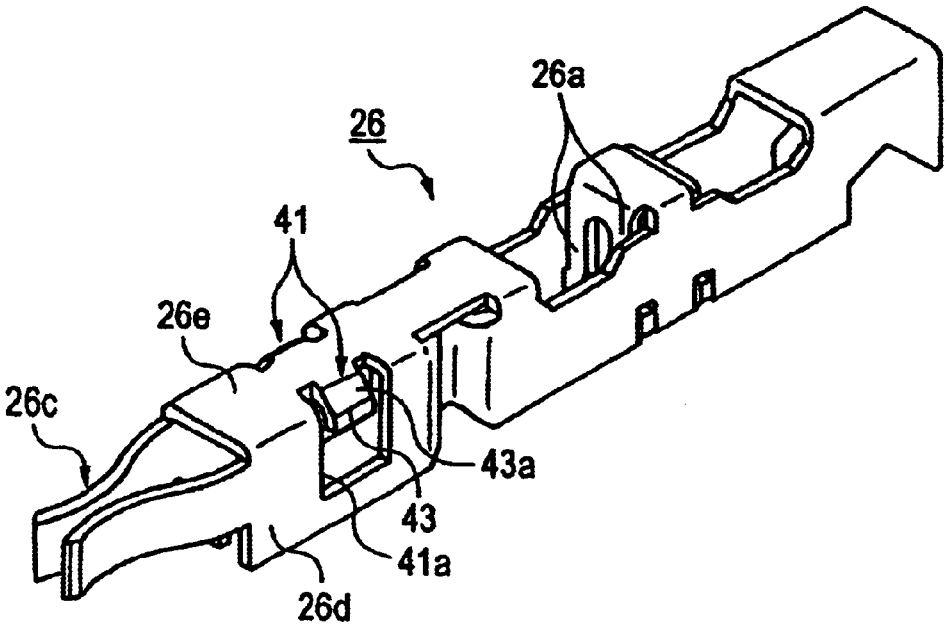
FIG. 4 is a perspective view of a press-contacting terminal in FIG. 1 as seen from the lower side.
Figure 5A:
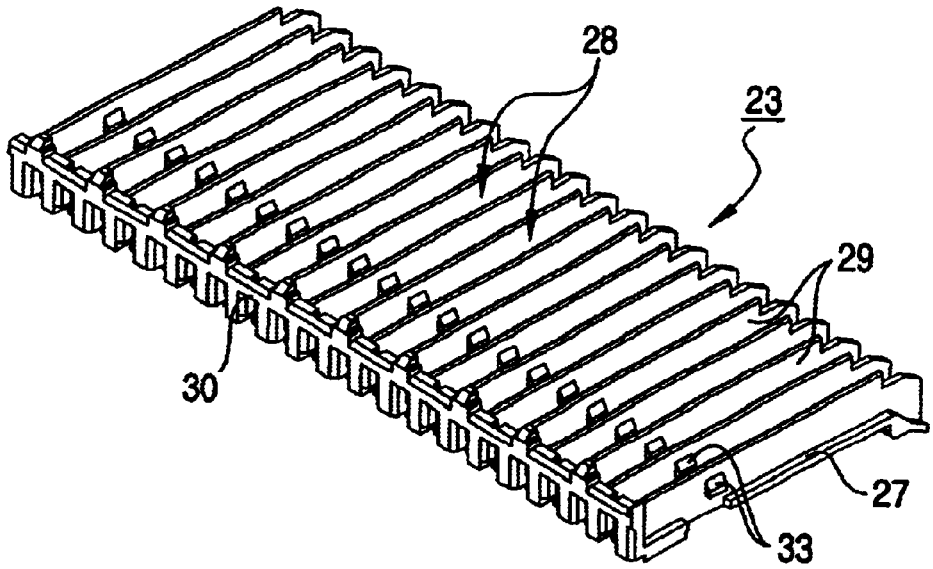
FIGS. 5A and 5B are perspective views of an insulating housing in FIG. 1 as seen from the upper and lower sides, respectively.
Figure 5B:
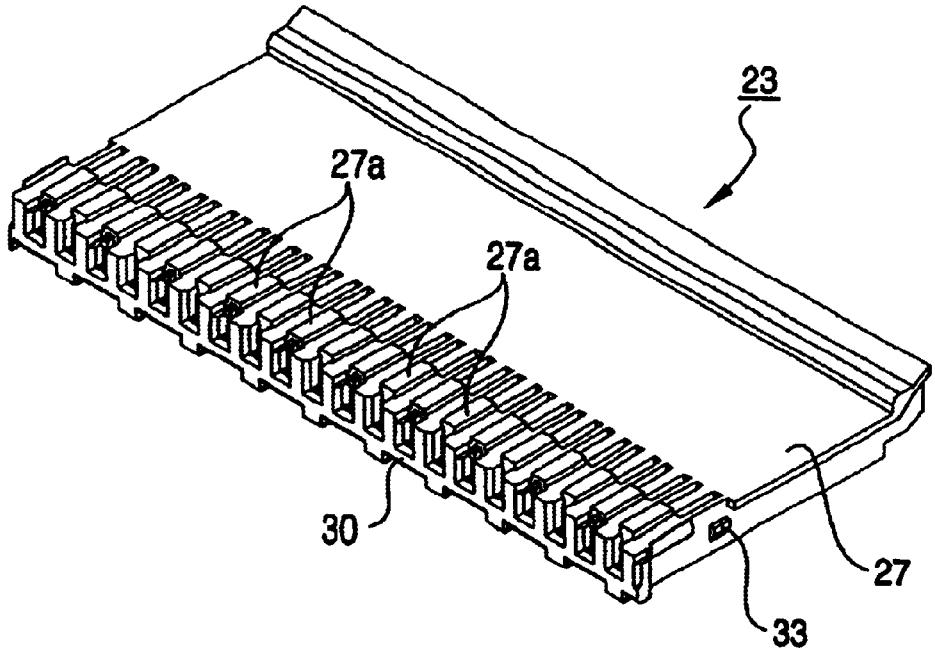
Figure 6:
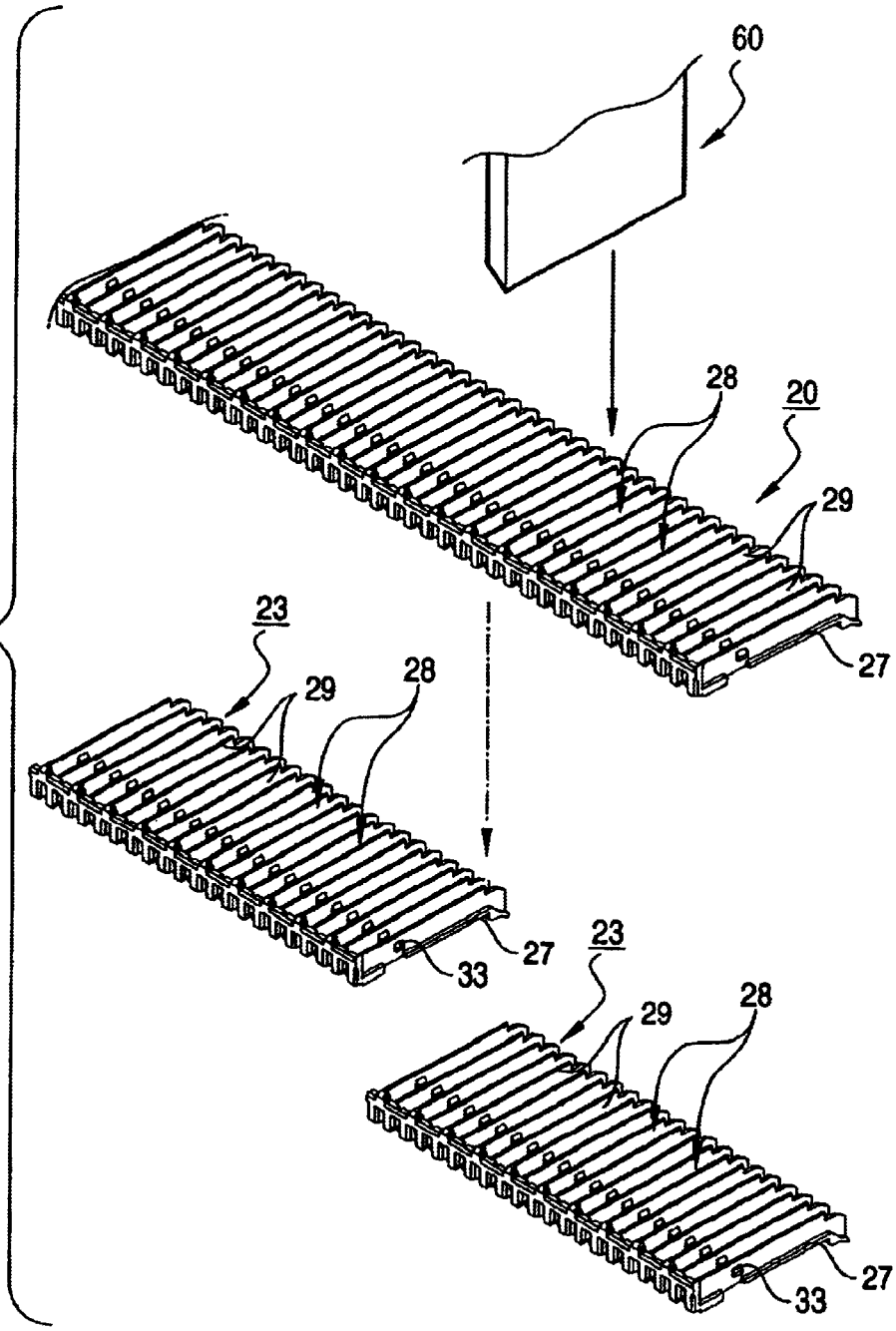
FIG. 6 is a view explanatory of a method of forming the insulating housing shown in FIG. 5.
Figure 7:
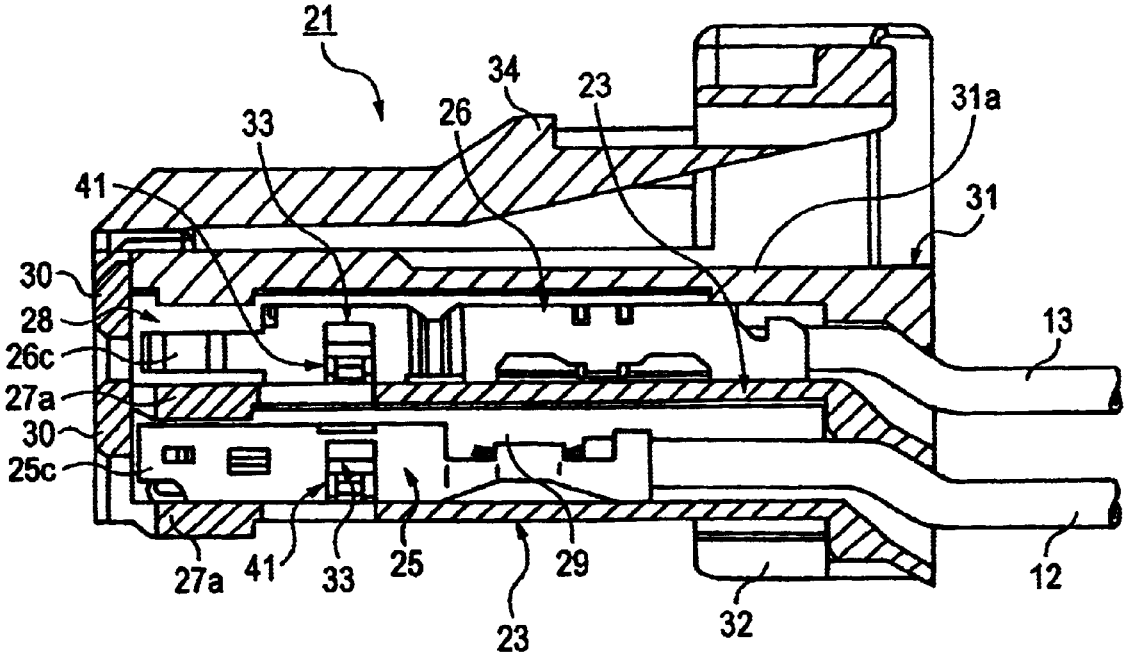
FIG. 7 is a longitudinal cross-sectional view of the connector of FIG. 2.
Figure 8:
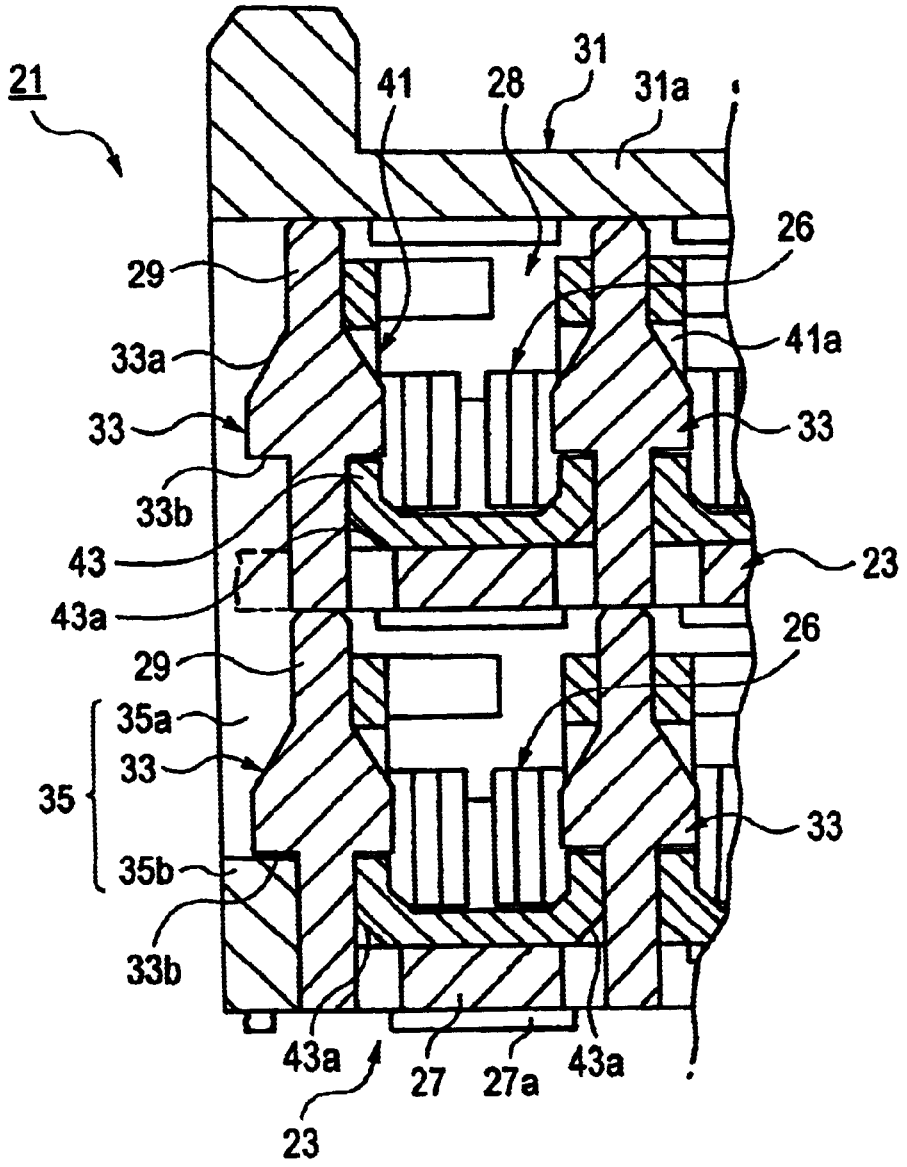
FIG. 8 is an enlarged, transverse cross-sectional view of an important portion of the connector of FIG. 7.
Figure 9:
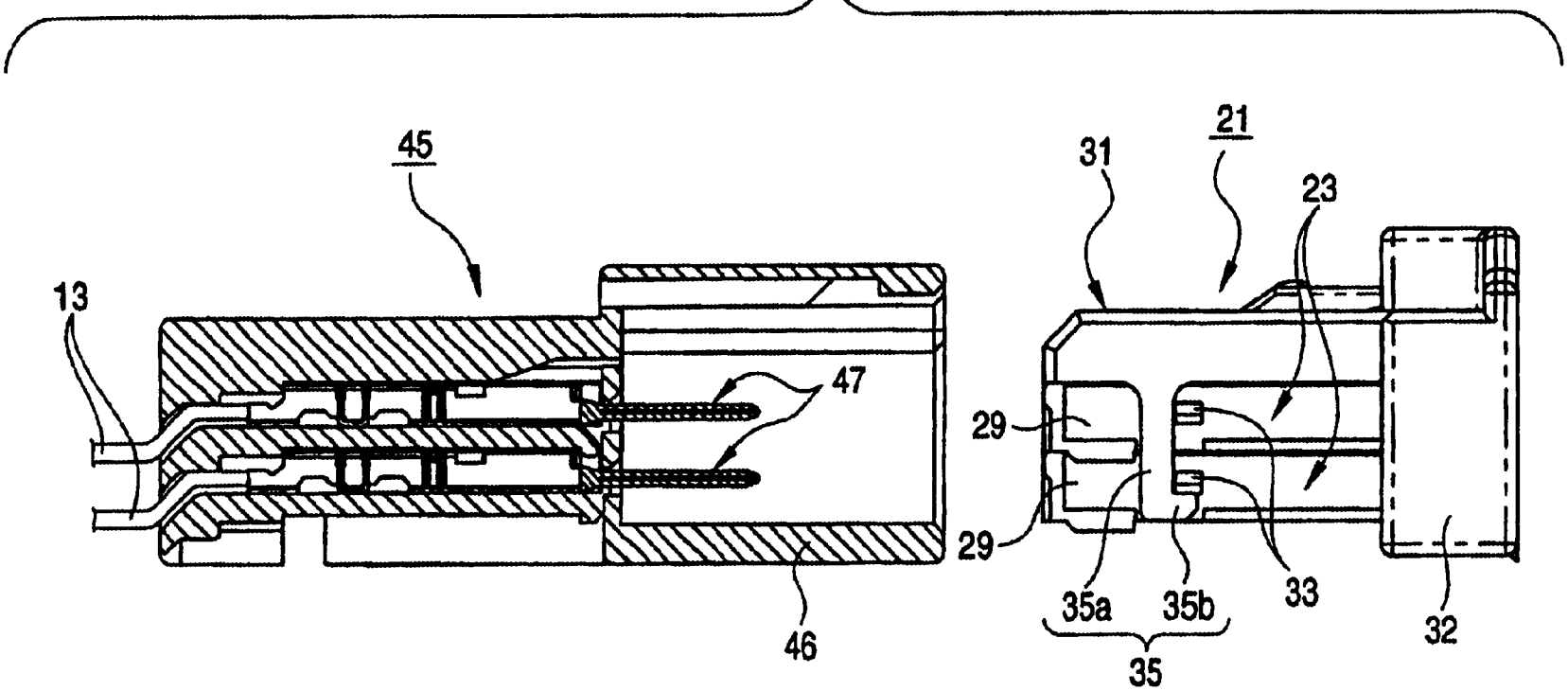
FIG. 9 is a partly-cross-sectional, front-elevational view showing the connector of FIG. 1 and a mating connector.

FIG. 1 is an exploded, perspective view of one preferred embodiment of the connector of the invention, FIG. 2 is a perspective view of the connector of FIG. 1 in its assembled condition, FIG. 3 is a perspective view of a press-clamping terminal in FIG. 1 as seen from the lower side, FIG. 4 is a perspective view of a press-contacting terminal in FIG. 1 as seen from the lower side, FIGS. 5A and 5B are perspective views of an insulating housing in FIG. 1 as seen from the upper and lower sides, respectively, FIG. 6 is a view explanatory of a method of forming the insulating housing shown in FIG. 5, FIG. 7 is a longitudinal cross-sectional view of the connector of FIG. 2, FIG. 8 is an enlarged, transverse cross-sectional view of an important portion of the connector of FIG. 7, and FIG. 9 is a partly-cross-sectional, front-elevational view showing the connector of FIG. 1 and a mating connector.

The connector 21 of this embodiment has been developed for use with an automotive wire harness. As shown in FIGS. 1 and 2, this connector comprises the insulating housings 23, each having a plurality of juxtaposed common terminal receiving portions (terminal receiving portions) 28 each having an upper opening for the insertion of a connection terminal (a press-clamping terminal 25 or a press-contacting terminal 26), and a cover member 31 for covering the upper openings of the common terminal receiving portions 28 of the insulating housings 23 arranged in a two-stage manner.

Each of the press-clamping terminal 25 and the press-contacting terminal 26 is a pressed product formed from an electrically-conductive metal sheet.

As shown in FIG. 3, the press-clamping terminal 25 includes conductor-clamping claws 25*a* for press-clamping an internal conductor of a sheathed wire 12, and sheath-clamping claws 25*b* for holding a sheath of the sheathed wire 12, and a female terminal fitting portion 25*c* for fitting on a male connection terminal 47 (see FIG. 9) in the mating connector 45, and the clamping claws 25*a* and the clamping claws 25*b* are formed at a rear end portion of the terminal 25 while the terminal fitting portion 25*c* is formed at a front end portion thereof.

As shown in FIG. 4, the press-contacting terminal 26 includes two pairs of opposed press-contacting blades 26*a* and 26*a* for cutting a sheath 13*b* of a sheathed wire 13 to come into contact with an internal conductor 13*a* thereof, and a female terminal fitting portion 26*c* for fitting on the connection terminal 47 in the mating connector 45, and the press-contacting blades 26*a* are formed a rear end portion of the terminal 26 while the terminal fitting portion 26*c* is formed at a front end portion thereof.

In the insulating housing 23 of this embodiment, a plurality of partition walls 29 are formed upright on a long base plate portion 27 at predetermined intervals, so that the plurality of common terminal receiving portions 28 are formed by the partition walls 29, as shown in FIG. 5A. The press-clamping terminal 25 or the press-contacting terminal 26 is inserted into each common terminal receiving portion 28 through the upper opening thereof. Namely, each terminal 25, 26 can be inserted into the corresponding common terminal receiving portion 28 in the same direction (from the upper side in FIG. 1) as the direction of press-contacting of the wire 13 relative to the press-contacting terminal 26.

A front wall 30 is formed integrally at a front end of the insulating housing 23, and terminal insertion ports each for receiving and guiding the corresponding male connection terminal 47 of the mating connector 45 are formed in this front wall 30.

As shown in FIG. 5B, terminal holding ribs 27*a*, to which the terminal fitting portions 25*c*, 26*c* of the terminals 25, 26, inserted respectively in the common terminal receiving portions 28, are to be opposed, are formed on and project from the reverse surface of the base plate portion 27.

As shown in FIG. 6, the insulating housing 23 of this embodiment is formed by cutting a chain housing 20 (beforehand integrally molded into a long, chain-like construction extending in the direction of juxtaposition of common terminal receiving portions 28) into a length or section, having a required number of terminal receiving portions 28 by a cutter 60, at a later stage.

Therefore, when many kinds of connectors 21, having different numbers of poles, are required to be produced in a small amount, the insulating housings 23, having different numbers of terminal receiving portions, can be obtained by suitably changing the cutting position of the cutter 60 without the need for changing the design of molds for forming the chain housing 20. Therefore, the kinds of the required molds can be reduced, so that the production cost can be reduced.

Retaining projections 33, serving as terminal retaining portions, are formed respectively on opposite sides of each of the partition walls 29, forming the common terminal receiving portions 28 of the insulating housing 23, and each pair of opposed retaining projections 33 are engaged respectively with housing engagement portions 41 of the press-clamping terminal 25 or the press-contacting terminal 26 (inserted in the corresponding common terminal receiving portion 28 through the upper opening thereof) to effect the positioning of the terminal in the direction of the axis thereof.

As shown in FIG. 8, the retaining projection 33 has a slanting surface 33*a* at that side thereof close to the upper side of the housing, and also has a horizontal surface 33*b* (for retaining purposes) at that side thereof close to the lower side of the housing.

As shown in FIGS. 3 and 4, each housing engagement portion 41 of the press-clamping terminal 25 (the press-contacting terminal 26) includes a retaining opening 41*a* (for fitting on the retaining projection 33), formed through a corresponding one of a pair of terminal side walls 25*d* and 25*d* (26*d* and 26*d*) which are to be opposed to the partition walls 29 of the insulating housing 23, and a stamped-out, resilient retaining piece portion 43 which extends from a terminal bottom wall 25*e* (26*e*) generally along the terminal side wall 25*d* (26*d*).

Therefore, for example, when the press-contacting terminal 26 is inserted into the common terminal receiving portion 28 of the insulating housing 23 through the upper opening thereof, the resilient retaining piece portion 43 of each housing engagement portion 41 abuts against the slanting surface 33*a* of the retaining projection 33, and is resiliently deformed inwardly, so that the retaining projection 33 is fitted into the retaining opening 41*a*. A slanting guide surface 43*a* is formed at an abutting portion of the resilient retaining piece portion 43, and by doing so, the insertion of the press-contacting terminal 26 can be effected smoothly.

The press-contacting terminal 26 is pushed into the common terminal receiving portion 28, and when the resilient retaining piece portions 43 slide past the retaining projections 33, respectively, as shown in FIGS. 7 and 8, the resilient retaining piece portions 43 are brought into engagement with the horizontal surfaces 33*a* of the retaining projections 33, respectively, by their resilient restoring force, so that the press-contacting terminal 26 is prevented from upward withdrawal.

At this time, each retaining projection 33 is fitted into the retaining opening 41*a* through the terminal bottom wall 25*e*, and is engaged with the edge of this opening, so that the positioning of the press-contacting terminal 26 in the direction of the axis thereof is effected.

The housing engagement portions 41 of the press-clamping terminal 25 are similar in construction to the housing engagement portions 41 of the press-contacting terminal 26, and therefore when the press-clamping terminal 25 is inserted into the common terminal receiving portion 28, this terminal can be received and held in the common terminal receiving portion in a similar manner.

As shown in FIGS. 7 and 8, the insulating housings 23 and 23 are arranged in a two-stage manner, and in this condition the upper openings of the common terminal receiving portions 28 of the lower insulating housing 23 are covered with the base plate portion 27 of the upper insulating housing 23, and the upper openings of the common terminal receiving portions 28 of the upper insulating housing 23 are covered with a cover body 31*a* of the cover member 31 connected to these insulating housings in a stacked manner.

At this time, the terminal holding ribs 27*a*, formed on the reverse surface of the base plate portion 27 of the upper insulating housing 23, are opposed respectively to the terminal fitting portions 25*c* of the press-contacting terminals 25, inserted respectively in the common terminal receiving portions 28 of the lower insulating housing 23, and hold the press-contacting terminals 25 in their respective predetermined positions.

Namely, even if any of the press-contacting terminals 25, disposed at the lower position, is not properly inserted in the common terminal receiving portion 28, the corresponding terminal holding rib 27*a* can push this press-contacting terminal 25 into the common terminal receiving portion 28 upon stacking of the upper insulating housing 23 on the lower insulating housing 23, so that this press-contacting terminal 25 can be properly received in the common terminal receiving portion.

As shown in FIGS. 1 and 2, cover locks 32 for holding rear portions of opposite side edges of the insulating housings 23 and 23 are formed respectively at opposite side edges of the cover body 31*a* of a generally rectangular shape, and cover engagement portions 35 for engagement with front portions of the opposite side surfaces of the insulating housings 23 and 23 are formed respectively at the opposite side edges of the cover body 31*a*.

A lock arm 34 for being fittingly locked to the mating connector 45 is formed on the upper surface of the cover body 31*a*.

As shown in FIG. 9, each cover engagement portion 35 includes an elastic leg portion 35*a*, which extends downwardly past the front sides of the exposed retaining projections 33 formed on the outer side walls of the stacked insulating housings 23 and 23, and a hook portion 35*b* which is formed at a lower end of the elastic leg portion 35*a*, and is engageable with the horizontal surface 33*b* of the retaining projection 33.

In this embodiment, the length of the elastic leg portion 35*a* of each cover engagement portion 35 is so determined that the cover engagement portion 35 can be engaged with the retaining projection 33 on the lower insulating housing 23.

Namely, when the chain housing 20 is cut into a length or section having a required number of terminal receiving portions, the terminal retaining portions 33, formed respectively on the relevant partition walls 29, are necessarily exposed to the opposite (outer) side walls of the thus formed insulating housing 23 regardless of the cutting position, and therefore the cover engagement portions 35 can be engaged with the terminal retaining portions 33, respectively, to connect the cover member 31 to the insulating housing 23.

Figure 10:
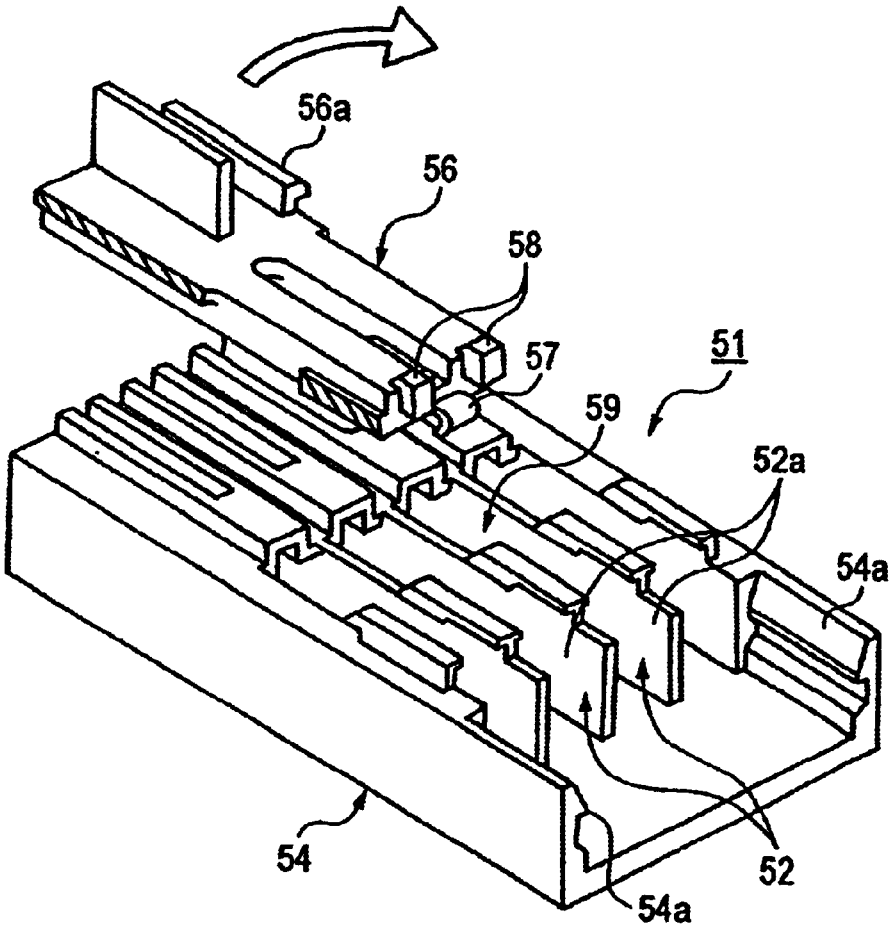
PRIOR ART FIG. 10
FIG. 10 is a perspective view showing a conventional connector.

Therefore, any special cover retaining portions, such as the cover retaining portions 54*a* of the insulating housing 54 of the conventional connector 51 shown in FIG. 10, do not need to be provided at the insulating housing 23.

Therefore, in contrast with the conventional insulating housing 54, having the cover retaining portions 54*a* formed respectively in the opposite side walls thereof, a connector fitting portion of the connector 21 is prevented from increasing in size.

And besides, in the insulating housing 23, the retaining projections 33, each having a small size and a simple shape, are merely formed respectively on the opposite sides of each partition wall 29, and therefore the pitch of the common terminal receiving portions 28 can be decreased by reducing the thickness of the partition walls 29 forming the common terminal receiving portions 28, and therefore the multi-pole connector can be easily formed into a compact size.

The hook portion 35*b* of the cover engagement portion 35 is engaged with the horizontal surface 33*b* of the retaining projection 33, formed on the outer side wall of the insulating housing 23 in such a manner that this hook portion extends from the front side of the retaining projection 33 along the horizontal surface 33*b*, and the lower end of the hook portion 35*b* does not project beyond the reverse surface (lower surface in the drawings) of the base plate portion 27 as shown in FIGS. 8 and 9.

Therefore, despite the fact that the cover engagement portions 35 are formed at the male connector-fitting portion of the connector 21, a female connector-fitting portion of a housing 46 of the mating connector 45 for fitting on the male connector-fitting portion will not be increased in size.

The constructions of the insulating housings, the connection terminals, the cover member, the cover engagement portions and so on of the connector of the present invention are not limited to the constructions of the above embodiment, and various forms can be adopted within the scope of the invention.

For example, in the connector 21 of the above embodiment, although the two (upper and lower) insulating housings 23 are stacked together to provide the connector structure having the plurality of (upper and lower) rows of common terminal receiving portions 28, there can be provided a connector structure in which the single insulating housing 23 is used, or three or more insulating housings 23 are stacked together. In this case, it is only necessary to suitably change the length of the cover locks 32 of the cover member 31 and the length of the cover engagement portions 35, and the common insulating housings 23 can be used.

In the connector of the present invention, the insulating housing, having the plurality of juxtaposed terminal receiving portions, is formed by cutting the chain housing (beforehand integrally molded into a long, chain-like construction extending in the direction of juxtaposition of the terminal receiving portion) into a length or section, having a required number of terminal receiving portions, at a later stage. Therefore, the various insulating housings, having different numbers of terminal receiving portions, can be obtained merely by changing the cutting position.

Therefore, even when many kinds of connectors, having different numbers of poles, are required to be produced, it is not necessary to prepare many kinds of molds for the various insulating housings having different numbers of terminal receiving portions, and the production cost can be reduced.

When the chain housing is cut, the terminal retaining portions, formed on the partition walls, are exposed to the outer side walls of the insulating housing, and therefore the cover engagement portions can be engaged with the corresponding terminal retaining portions to connect the cover member to the insulating housing.

Therefore, any special cover retaining portion for engagement with the cover engagement portion of the cover member does not need to be provided at the insulating housing, and the increased size of the insulating housing, which would otherwise be caused by the provision of such cover retaining portion on the insulating housing, is prevented.

Therefore, there can be provided the improved connector which can easily meet with a required number of circuits and a required circuit form at low costs, and also can be formed into a compact size despite the fact that the connector is provided with the cover member for covering the upper openings of the terminal receiving portions.

What is claimed is:

1. A connector comprising:

(A) an insulating housing including
- a long base plate,
- a plurality of partition walls formed upright on said long base plate portion, so that a plurality of juxtaposed terminal receiving portions are formed, each terminal receiving portion having an opening for inserting a connection terminal, and
- a plurality of terminal retaining portions formed on said partition walls, each of which is engageable with a housing engagement portion of the connection terminal inserted into the terminal receiving portion through the opening thereof so as to position said connection terminal,
- wherein said insulating housing is formed by cutting a chain housing between adjacent partition walls, into a section having a required number of terminal receiving portions, such that at least one of said terminal retaining portions is exposed to an outer side wall of said insulating housing; and (B) a cover member for covering the openings of said terminal receiving portions, including
- a cover engagement portion formed in said cover member, engageable with at least one of said terminal retaining portions, which is exposed at the outer side wall of said insulating housing, so as to connect said cover member with said insulating housing.

2. The connector according to claim 1, wherein each of the terminal receiving portions is configured to have the same width with each other.

3. The connector according to claim 1, wherein each of said terminal retaining portions is configured to have the same structure with each other.

4. The connector according to claim 1, wherein said connection terminal is a pressed product formed from an electrically-conductive sheet metal.

5. The connector according to claim 1, further comprising terminal holding ribs formed on a bottom surface of said long base plate.

6. The connector according to claim 1, further comprising multiple insulating housings arranged in a stacked manner.

7. The connector according to claim 1, further comprising a cover lock on each side edge of said cover member, wherein said cover lock is substantially rectangular.

8. The connector according to claim 1, wherein said terminal retaining portion comprises an elastic leg portion, which extends downwardly past said retaining projections, and a hook portion formed at a lower end of said elastic leg portion, such that the hook portion engages with said retaining projections.

* * * * *